US007596895B2

(12) United States Patent
Jones

(10) Patent No.: US 7,596,895 B2
(45) Date of Patent: Oct. 6, 2009

(54) WEAR ASSEMBLY

(75) Inventor: Larren F. Jones, Aloha, OR (US); Daniel Thomas Jones, legal representative, Beaverton, OR (US)

(73) Assignee: ESCO Corporation, Portland, OR (US)

( * ) Notice: Subject to any disclaimer, the term of this patent is extended or adjusted under 35 U.S.C. 154(b) by 200 days.

(21) Appl. No.: 11/799,094

(22) Filed: Apr. 30, 2007

(65) Prior Publication Data

US 2007/0204490 A1 Sep. 6, 2007

Related U.S. Application Data

(63) Continuation-in-part of application No. 11/529,447, filed on Sep. 28, 2006, and a continuation-in-part of application No. 10/812,348, filed on Mar. 30, 2004, now abandoned.

(51) Int. Cl.
*E02F 9/28* (2006.01)

(52) U.S. Cl. ..... 37/452

(58) Field of Classification Search ..... 37/446–460; 172/701.1, 701.2, 701.3
See application file for complete search history.

(56) References Cited

U.S. PATENT DOCUMENTS

| | | | |
|---|---|---|---|
| 775,770 | A | 11/1904 | Herrod, Jr. |
| 1,031,138 | A | 7/1912 | McKee et al. |
| 1,076,548 | A | 10/1913 | Butler |
| 1,485,243 | A | 2/1924 | Blake |
| 1,775,984 | A | 9/1930 | Younie |
| 1,885,326 | A | 11/1932 | Brune |
| 1,959,847 | A | 5/1934 | Buskirk |
| 1,992,591 | A | 2/1935 | Whisler |
| 2,870,667 | A | 1/1959 | Murtaugh |
| 2,996,291 | A | 8/1961 | Krekeler |
| 3,160,967 | A | 12/1964 | Nichols |
| 3,171,500 | A | 3/1965 | Dils, Jr. |
| 3,345,765 | A | 10/1967 | Petersen |
| 3,357,117 | A | 12/1967 | Petersen |
| 3,371,437 | A | 3/1968 | Wilson et al. |
| 3,388,488 | A | 6/1968 | Duplessis |
| 3,413,739 | A | 12/1968 | Guinot |

(Continued)

FOREIGN PATENT DOCUMENTS

| | | |
|---|---|---|
| WO | WO 02/12642 | 2/2002 |

OTHER PUBLICATIONS

ESCO Brochure; "Instructions for T4-V71, T4L-V71, & T4R-V&1 Toplok® Adapters", M/LMS-504-0302, 2002, pp. 1-8.

(Continued)

*Primary Examiner*—Robert E Pezzuto
(74) *Attorney, Agent, or Firm*—Steven P. Schad

(57) ABSTRACT

A wear assembly to protect the front edge of an excavating bucket, which is secure, stable, easy to use, readily manufactured, and provides increased safety, and which eliminates any need for holes to be formed in the lip. The wear assembly includes a wear member that has a pair of legs to straddle the front edge of the bucket. One of the legs defines an axial slot, which has opposing grooves for receiving rails of a boss fixed to the bucket. The grooves narrow in a forward direction to permit easier installation and removal of the wear member, to permit use of side wings without interference from adjacent wear parts, and to enable enhanced resistance under some loads.

18 Claims, 8 Drawing Sheets

U.S. PATENT DOCUMENTS

| | | | |
|---|---|---|---|
| 3,426,459 | A | 2/1969 | Petersen |
| 3,497,973 | A | 3/1970 | Campbell |
| 3,537,735 | A | 11/1970 | Hawk |
| 3,621,594 | A | 11/1971 | Hahn et al. |
| 3,685,177 | A | 8/1972 | Hahn et al. |
| 3,708,895 | A | 1/1973 | Griffith et al. |
| 3,736,664 | A | 6/1973 | Black et al. |
| 3,762,079 | A | 10/1973 | Lukavich et al. |
| 3,841,007 | A | 10/1974 | Howarth et al. |
| 3,851,413 | A | 12/1974 | Lukavich |
| 3,864,853 | A | 2/1975 | Klett et al. |
| 3,896,569 | A | 7/1975 | Thompson et al. |
| 3,919,792 | A | 11/1975 | Hahn et al. |
| 3,947,982 | A | 4/1976 | Mantovani |
| 3,974,579 | A | 8/1976 | Black et al. |
| 3,995,384 | A | 12/1976 | Wood |
| 4,006,544 | A | 2/1977 | Stepe |
| D245,780 | S | 9/1977 | Dahlberg et al. |
| 4,103,442 | A | 8/1978 | Zept |
| 4,129,934 | A | 12/1978 | Gettman |
| 4,205,469 | A | 6/1980 | Johansson et al. |
| 4,233,761 | A | 11/1980 | Ryerson |
| 4,267,653 | A | 5/1981 | Hahn et al. |
| 4,271,615 | A | 6/1981 | Jones |
| 4,290,214 | A | 9/1981 | Stepe |
| 4,317,300 | A | 3/1982 | Emrich et al. |
| 4,335,532 | A | 6/1982 | Hahn et al. |
| 4,373,831 | A | 2/1983 | Crawford |
| 4,404,760 | A | 9/1983 | Hahn et al. |
| 4,414,764 | A | 11/1983 | Johansson et al. |
| 4,433,496 | A | 2/1984 | Jones et al. |
| 4,449,309 | A | 5/1984 | Hemphill |
| 4,457,380 | A | 7/1984 | Curry |
| 4,501,079 | A | 2/1985 | Hahn et al. |
| 4,570,365 | A | 2/1986 | Bierwith |
| 4,577,423 | A | 3/1986 | Hahn |
| 4,626,034 | A | 12/1986 | Breuer et al. |
| 4,716,667 | A | 1/1988 | Martin |
| 4,748,754 | A | 6/1988 | Schwappach |
| RE33,042 | E | 9/1989 | Emrich |
| 4,899,830 | A | 2/1990 | Maguina-Larco |
| 4,932,478 | A | 6/1990 | Jones |
| 4,965,945 | A | 10/1990 | Emrich |
| 5,005,304 | A | 4/1991 | Briscoe et al. |
| 5,016,365 | A | 5/1991 | Robinson |
| 5,052,134 | A | 10/1991 | Bierwith |
| 5,056,243 | A | 10/1991 | Sprunger et al. |
| 5,063,695 | A | 11/1991 | Briscoe et al. |
| 5,063,696 | A | 11/1991 | Smith |
| 5,075,986 | A | 12/1991 | Smith et al. |
| 5,088,214 | A | 2/1992 | Jones |
| 5,241,765 | A | 9/1993 | Jones et al. |
| 5,283,965 | A | 2/1994 | Clendenning |
| 5,325,615 | A | 7/1994 | Hutchins et al. |
| 5,337,495 | A | 8/1994 | Pippins |
| 5,396,964 | A | 3/1995 | Shellhorn et al. |
| 5,410,826 | A | 5/1995 | Immel et al. |
| 5,412,885 | A | 5/1995 | Cornelius |
| 5,417,518 | A | 5/1995 | Bierwith |
| 5,438,774 | A | 8/1995 | Fletcher et al. |
| 5,452,529 | A | 9/1995 | Neuenfeldt et al. |
| 5,553,409 | A | 9/1996 | Irving |
| 5,564,508 | A | 10/1996 | Renski |
| 5,634,285 | A | 6/1997 | Renski |
| 5,653,048 | A | 8/1997 | Jones et al. |
| 5,713,145 | A | 2/1998 | Ruvang |
| 5,802,752 | A | 9/1998 | Quarfordt |
| 5,806,216 | A | 9/1998 | Renski |
| 5,852,888 | A | 12/1998 | Cornelius |
| 5,937,549 | A | 8/1999 | Bender et al. |
| 5,983,534 | A | 11/1999 | Robinson |
| 5,992,063 | A | 11/1999 | Mack |
| 6,145,224 | A | 11/2000 | Stickling |
| 6,151,812 | A | 11/2000 | Bierwith |
| 6,194,080 | B1 | 2/2001 | Stickling |
| 6,209,238 | B1 | 4/2001 | Ruvang |
| 6,393,739 | B1 | 5/2002 | Shambin et al. |
| 6,729,052 | B2 | 5/2004 | Ollinger et al. |

OTHER PUBLICATIONS

ESCO Booklet; "ESCO Toplok Adapter System For Plate Lips", Mining College '97, DMC Sep. 9, 1997, Illustrations 1-23.

Clark Equipment, Bucket Tooth Adapter Installation Drawing, No. 1546546, Mar. 13, 1970.

WEAR ASSEMBLY

This application is a continuation-in-part of co-pending U.S. patent application Ser. No. 11/529,447 filed Sep. 28, 2006, which in turn is a divisional application of U.S. patent application Ser. No. 10/812,348 filed Mar. 30, 2004.

THE FIELD OF THE INVENTION

The present invention pertains to a wear assembly for an excavating bucket.

THE BACKGROUND OF THE INVENTION

Excavating buckets for earth working equipment are typically subjected to harsh conditions. A series of wear members are usually provided along the lip of the bucket to improve the digging operation and protect against wear. Wear members have in the past been welded or mechanically secured in many different ways. Nevertheless, there is a need for an improved wear assembly in these environments.

SUMMARY OF THE INVENTION

The present invention pertains to an improved wear assembly for protecting an excavating bucket from wear, which is secure, stable, easy to use, readily manufactured, and provides increased safety. The present invention further eliminates any need for holes to be formed in the lip.

In accordance with one aspect of the invention, the wear assembly includes a wear member provided with a connector in the form of a tongue or slot which has rails or grooves, respectively, to couple with a complementary connector on a boss fixed to the bucket. The rails or grooves are formed with a curved and/or narrowing configuration to ease installation and removal of the wear member, permit the use of wings to better protect adjacent parts, and better resist some loads.

In accordance with another aspect of the invention, the wear member includes an interior which wraps about the front edge of the bucket and a boss fixed to the bucket. The interior has a first recess with a first set of opposed sidewalls to receive an upstanding support on a boss, and a second recess with a second set of opposed sidewalls spaced farther apart than the first set of opposed sidewalls to receive the sides of the boss. By using two sets of recesses, the wear member is more stably mounted and better able to resist side loads.

In accordance with another aspect of the invention, the wear member includes laterally extending wings to overlie adjacent parts, e.g., an adapter, attached to the lip to provide additional protection.

DETAILED DESCRIPTION OF THE PREFERRED EMBODIMENTS

Figure 1:
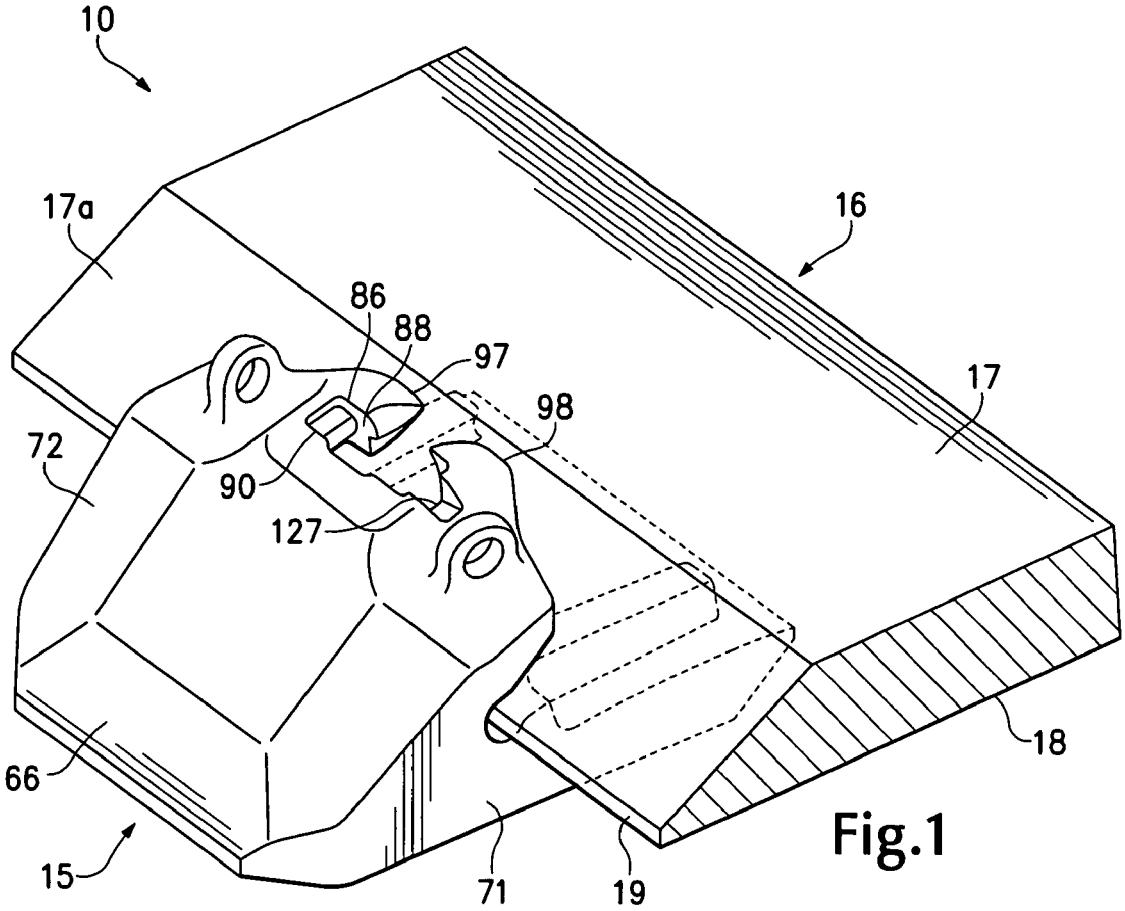
FIG. 1 is a perspective view of a wear member straddling a lip of a bucket in accordance with the present invention.
Figure 2:
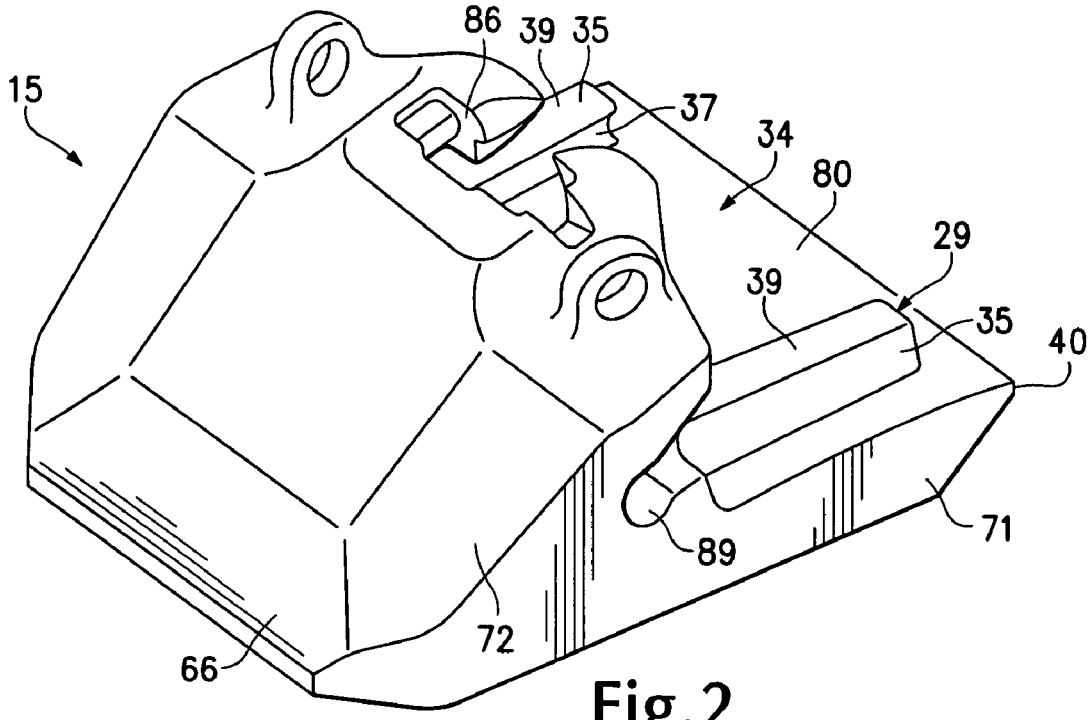
FIG. 2 is a front perspective view of a wear member of the invention.

The present invention pertains to a wear assembly 10 for an excavating bucket. While wear assembly 10 is particularly suited for securing a wear member 15 in the form of a shroud to a lip of a bucket, it could also be used to secure other kinds of wear members (e.g., wings or adapters) to the bucket. In a typical bucket, lip 16 includes an inner face 17, an outer face 18 and a front edge 19. Although the illustrated lip (FIG. 1) shows the inner face 17 with a ramp surface 17*a*, the invention can be used with other kinds of lips.

The invention is at times described in relative terms, such as forward, rearward, up, down, vertical, horizontal, etc. to ease understanding of the invention. These terms are generally to be considered relative to the orientation of the components in FIG. 1 (unless otherwise noted), and are not to be considered limitations on the invention. As can be appreciated, the wear member can be used and oriented in a variety of ways.

A boss or base 20 (FIGS. 8-10) has a pair of legs 21, 22 that straddle the lip 16 about front edge 19. Although first leg 21 is preferably the outer leg and second leg 22 the inner leg, they could be reversed. In the illustrated embodiment, the first or outer leg 21 has an inner surface 23 that sets against and extends along outer face 18 of lip 16. In the preferred construction, first leg 21 includes holes 27 to facilitate welding of the boss to the lip. In this embodiment, welding is also provided along brace 30 and grooves 31 at the end of second leg 22. While boss 20 is preferably welded to the lip, it could be formed (e.g., cast or forged) as an integral part of the lip or secured by mechanical means. In addition, the boss could be formed as a multiple of parts, which are integral or spaced apart, although a one-piece member is preferred for simplicity and strength.

Figure 9:
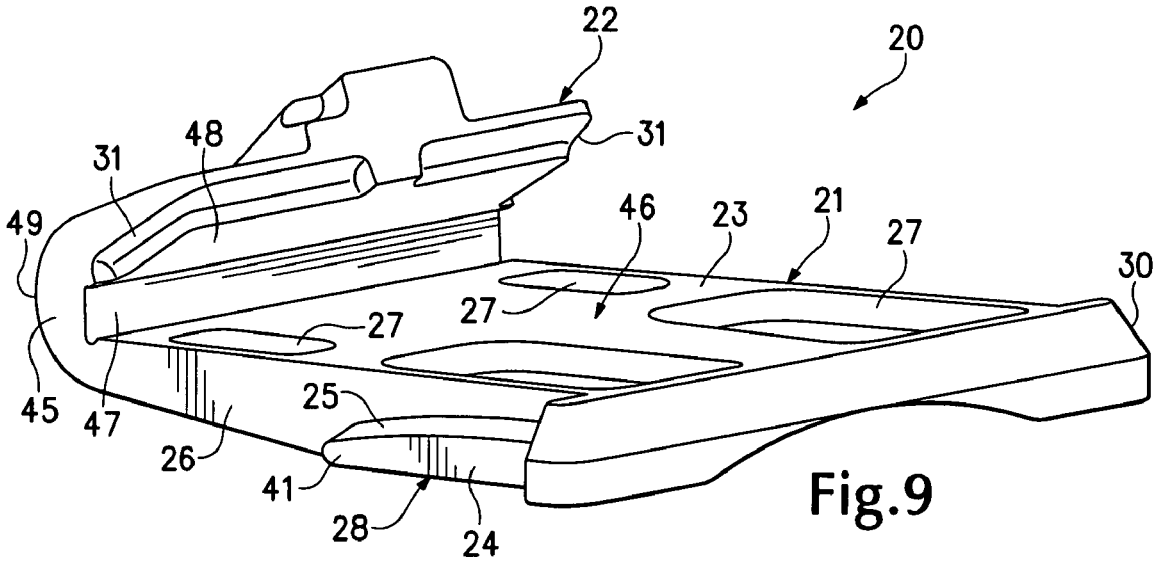
FIG. 9 is a rear perspective view of the boss.
Figure 10:
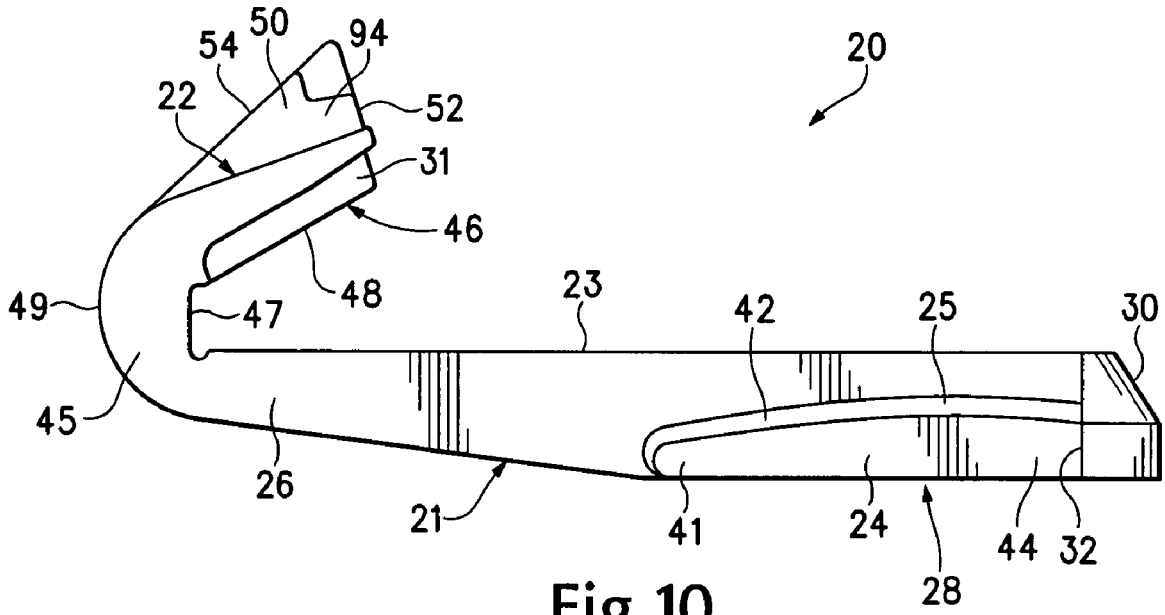
FIG. 10 is a side view of the boss.
Figure 11:
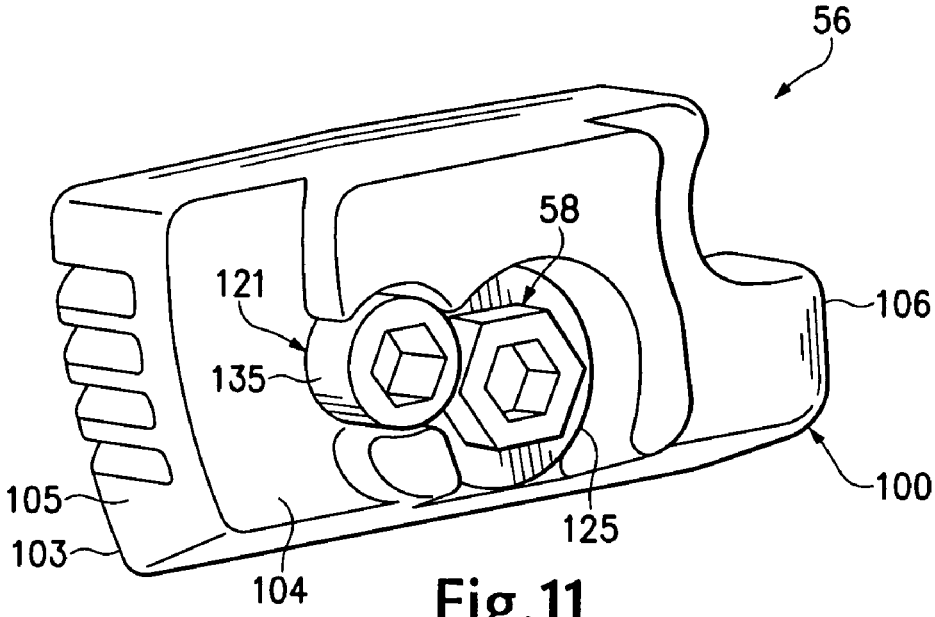
FIG. 11 is a perspective view of a lock of the present invention.
Figure 12:
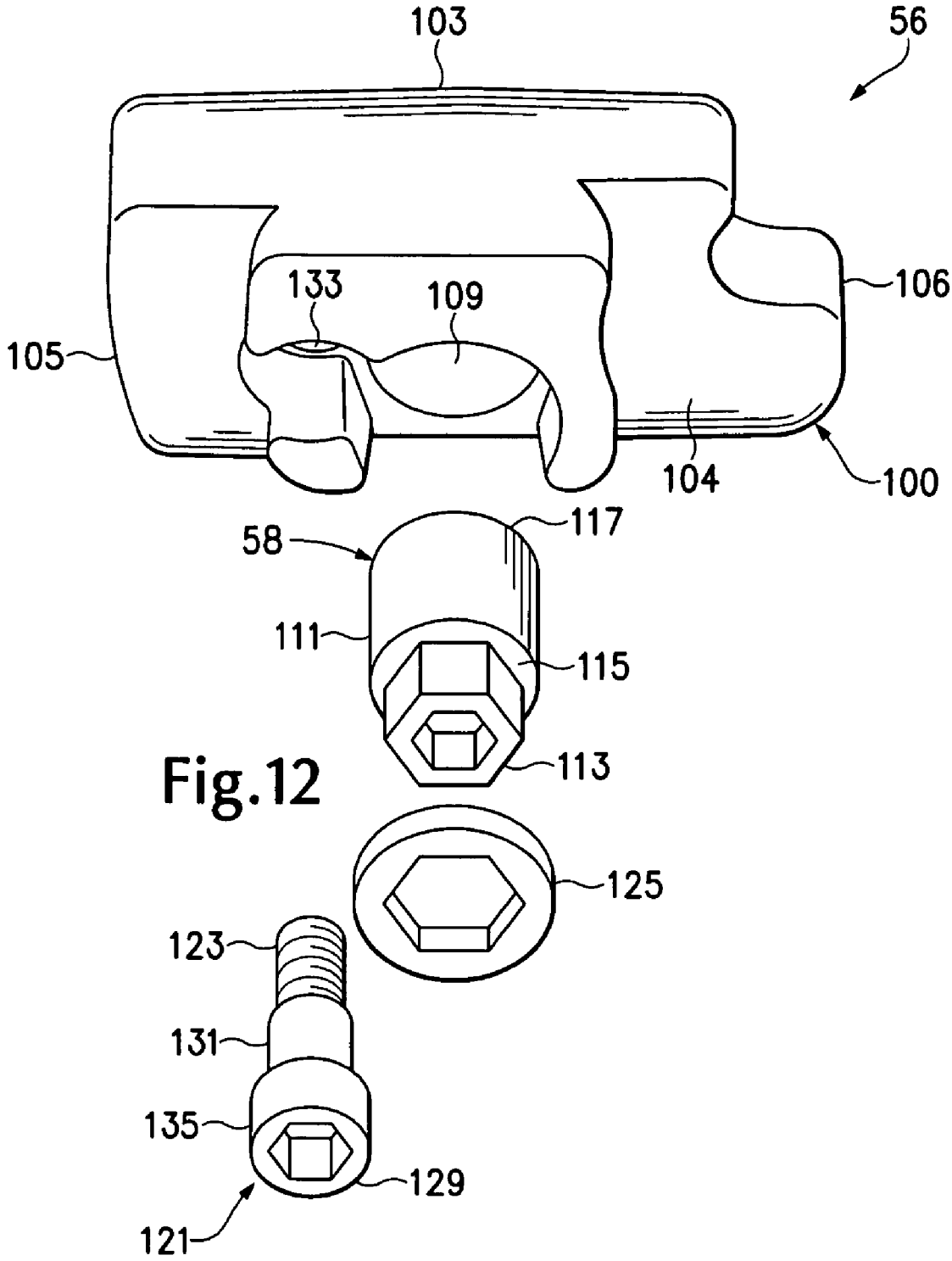
FIG. 12 is an exploded, perspective view of the lock.

Outer leg 21 includes a connector 28 that couples to a complementary connector 29 on wear member 15. In the illustrated embodiment, connector 28 is formed as rails 24 extending axially along sidewalls 26 of the boss (FIGS. 9 and 10). The rails project laterally outward from each sidewall 26 to define a generally inverted T-shaped cross-section, though other shapes are possible. Rails 24 include holding surfaces 25 that are offset from inner surface 23 so as to be spaced from the outer face 18 of the bucket which it faces.

Figure 8:
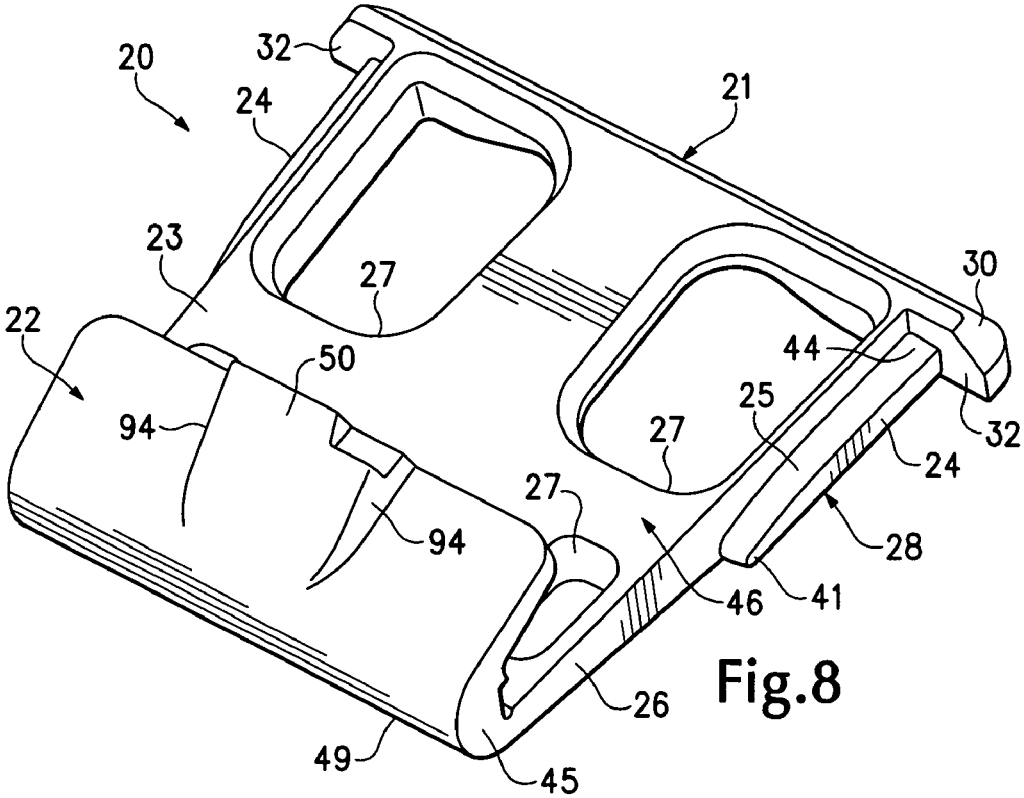
FIG. 8 is a front perspective view of a boss of the present invention.

A brace 30 preferably extends laterally across the rear end of first leg 21 (FIGS. 8-10). The rear ends 44 of rails 24 are preferably fixed to brace 30 to provide additional support to the rails when under load. Such support at the rear end of the rails is particularly advantageous in resisting vertical loads that tend to rotate or swing the wear member about the front edge of the lip. Brace 30 preferably extends outward of first leg 21 to define a stop surface 32 adapted to abut a rear end 40 of wear member 15 and thereby reduce the stress on the boss, which in turn, reduces the stress along front edge 19 of lip 16.

A front end 45 of boss 20 wraps around front edge 19 of lip 16. The interior 46 of boss 20 (i.e., the surface that faces lip 16) is shaped to generally conform to the shape of the particular lip to which it is fixed. In the illustrated embodiment, the interior 46 of boss 20 includes a corner surface 47 that sets against front edge 19, an inner surface 48 of second leg 22 that sets against ramp 17*a*, and inner surface 23 of first leg 21 that sets against outer face 18. The inner or second leg 22 preferably overlies only ramp surface 17*a* so that the boss is outside or below the inner face 17 to avoid impeding the gathering or dumping of the excavated material, but could extend along inner 17 rearward of ramp 17A. Also, other arrangements for attaching the boss are possible. For other kinds of lips, the interior would preferably be changed to generally match the lip profile.

The front face 49 of boss 20 preferably has a uniform curved shape to provide a smooth surface without corners to act as a thrust bearing face for wear member 15. In this way, the boss is able to provide a better bearing surface than the front of lip 16 with its relatively sharp and thinner front edge 19. Nevertheless, other shapes for front face 49 are possible. Inner leg 22 preferably includes an upstanding support 50 that forms an abutment for lock 56 (FIGS. 8-10). Support 50 includes a rear wall 52 to abut lock 56, a pair of sidewalls 94 and an upper inclined wall 54 that extends upward from front face 49.

Figure 3:
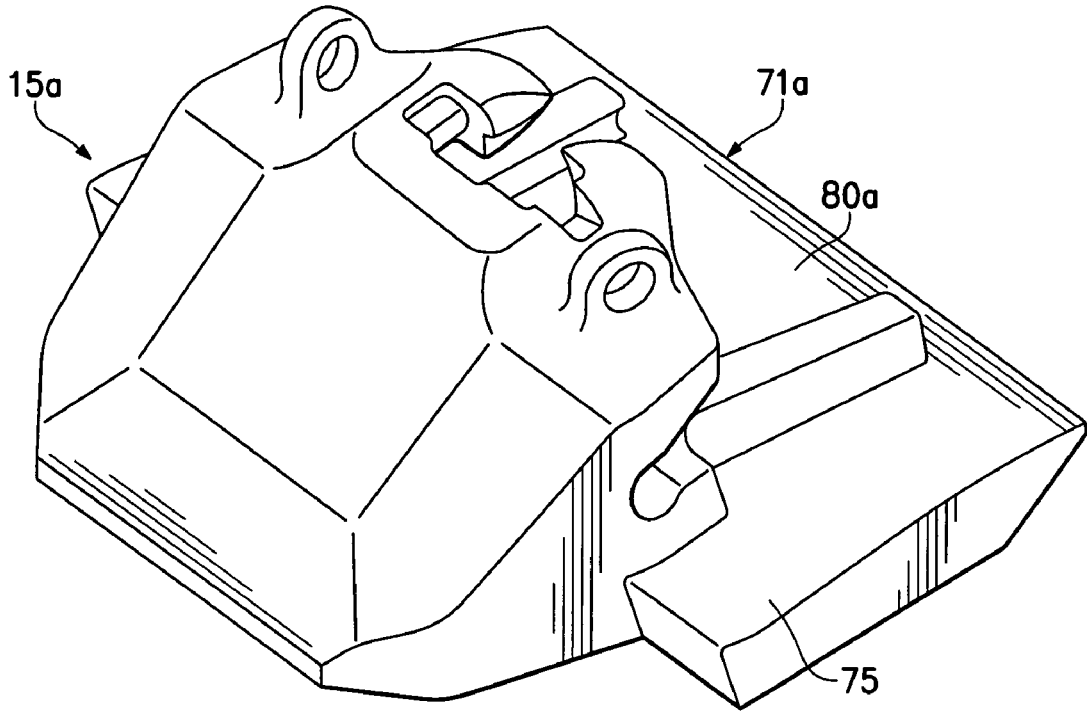
FIG. 3 is a front perspective view of an alternative wear member.
Figure 4:
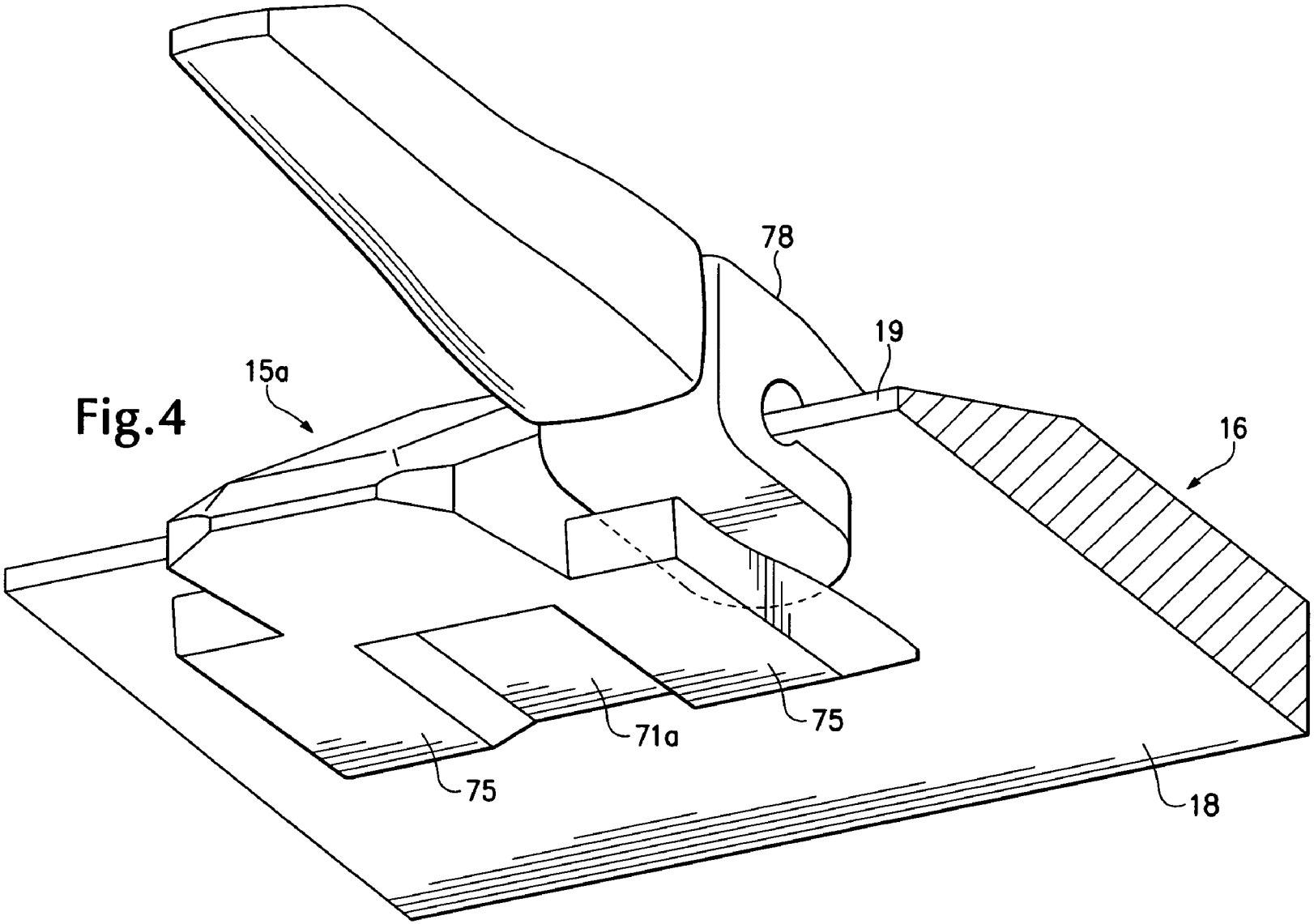
FIG. 4 is a partial perspective view from the bottom of a lip with the alternative wear member.
Figure 5:
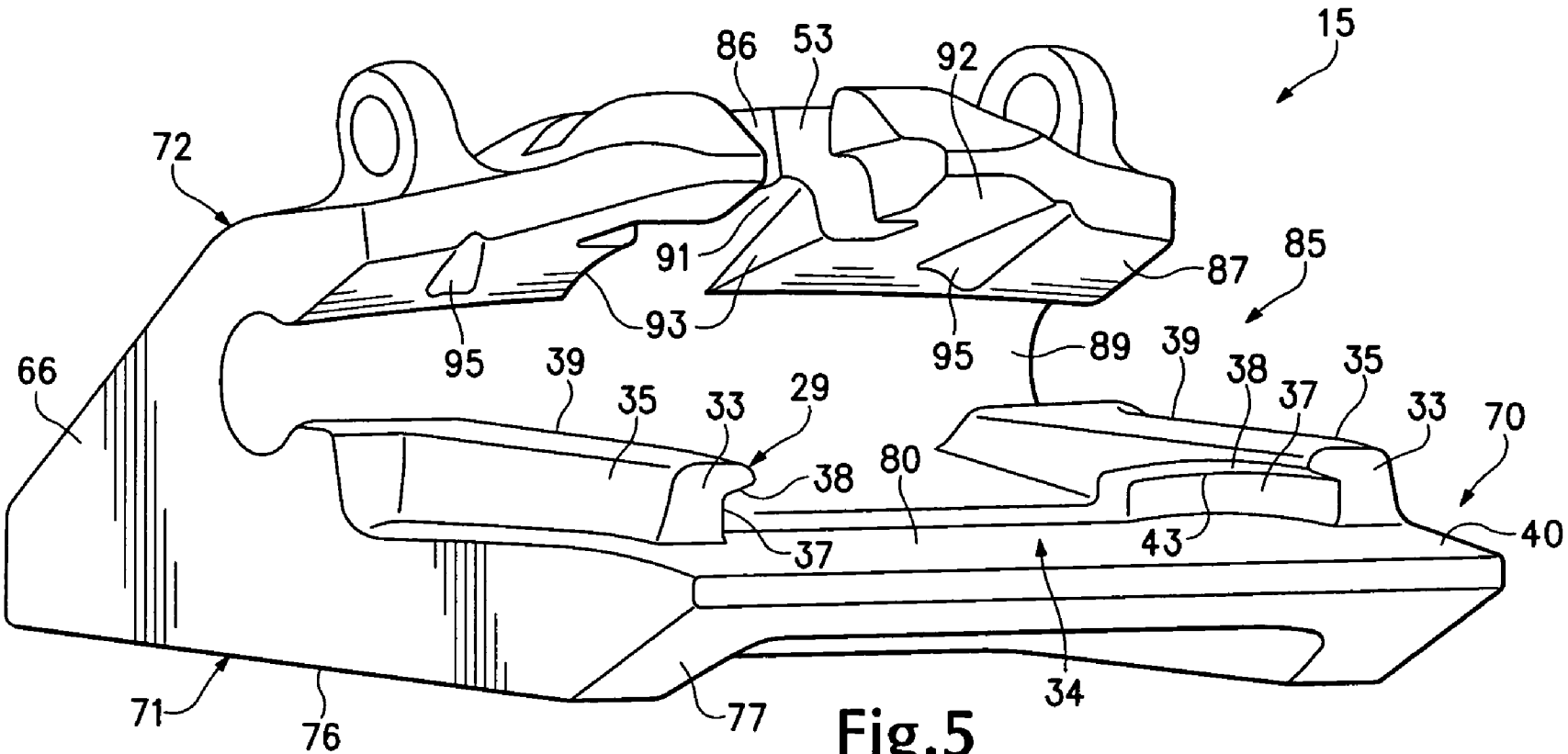
FIG. 5 is a rear perspective view of the wear member of the invention.
Figure 6:
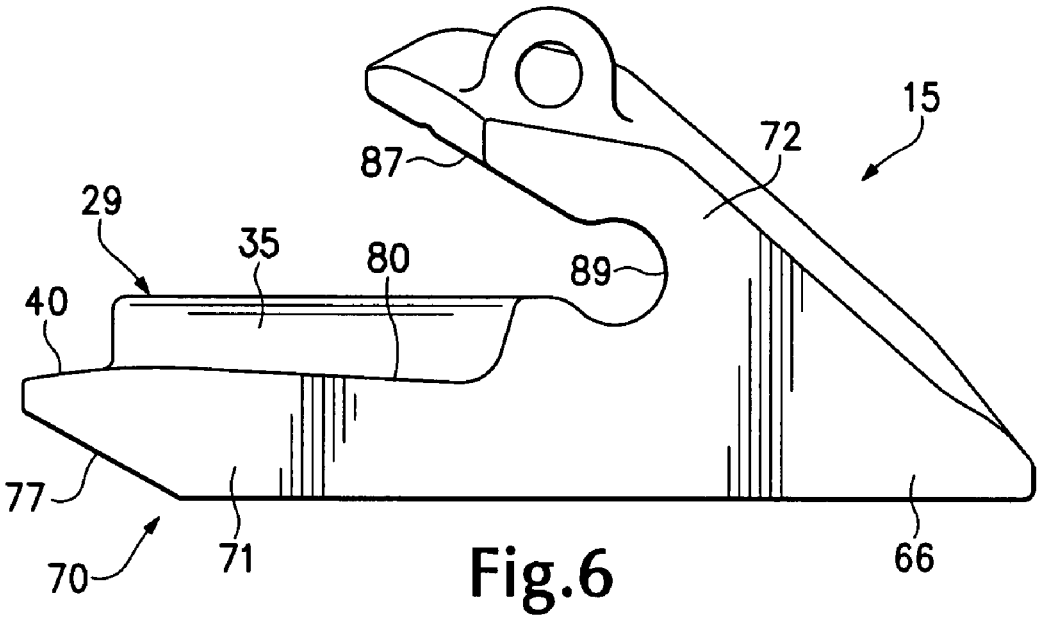
FIG. 6 is a side view of the wear member.
Figure 7:
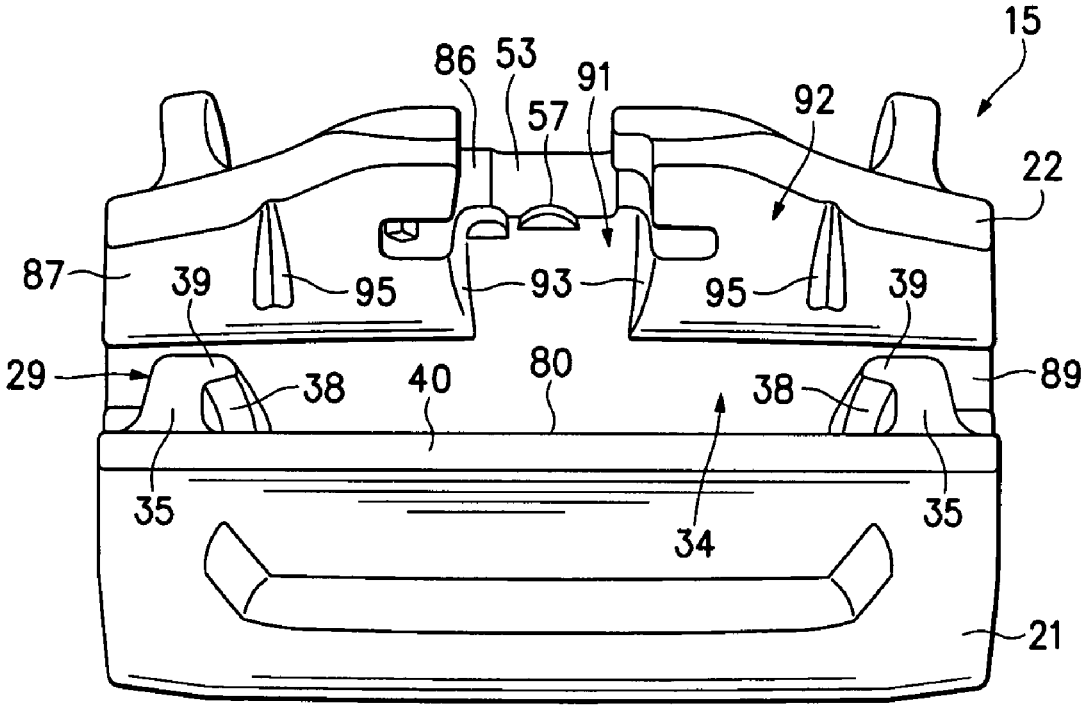
FIG. 7 is a rear view of the wear member.

Wear member 15 has a front end 66 and a rear end 70 that is bifurcated to define an outer or first leg 71 and an inner or second leg 72 (FIGS. 1-2 and 5-6). In use, wear member 15 overlies and straddles lip 16 and boss 20. As a result, boss 20 is largely shielded from the movement of abrasive earthen material passing over the component. Wear member 15 includes an interior 85 that includes inner face 80 of outer leg 71, inner face 87 of inner leg 72, and an inner corner surface 89 at the intersection of legs 71, 72 (FIGS. 5 and 6). Inner corner surface 89 has a shape that generally matches front face 49 of boss 20 to abut against it. Accordingly, in the preferred embodiment, inner corner surface 89 has a generally uniform curved surface. Outer leg 71 has a generally flat outer face 76 and a rear deflector face 77 that is inclined forwardly away from lip 16 to direct earthen material away from the wear member during reverse movement of the bucket. Wear member 15*a* also optionally includes wings 75 that project laterally, preferably from outer leg 71*a*, to overlie the adjacent wear parts 78 (e.g., adapters) and provide additional protection to the adjacent wear parts 78 (FIGS. 3 and 4). Wings 75 are offset from inner face 80*a* of outer leg 71*a* (i.e., spaced further from lip 16) to define clearance for the adjacent wear parts 78 when wear member 15*a* is fully seated on boss 20.

Connector 29 of wear member 15 extends along outer leg 21 in the form of a slot 34; i.e., dogleg flanges 35 extend along the inner surface 80 of outer leg 71 to define slot 34 (although slot 34 could be formed in other ways). Grooves 37 are preferably defined by inner surface 80 of outer leg 71 and retaining surface 38 on flange 35. Rails 24 are received into side grooves 37 along flanges 35 such that the distal ends 39 of flanges 35 are received between rails 24 and outer surface 18 with retaining surfaces 38 opposed to holding surfaces 25. Alternatively, connectors 28, 29 could be reversed with a tongue having rails formed on the wear member 15 and a slot having side grooves to be formed on the boss 20.

Holding surfaces 25 of rails 24 are preferably curved to have a convex shape, and retaining surfaces 38 a complementary concave shape. This curve results in a narrowing of the rail as it extends forwardly. This narrowing of rails 24 allows wear member 15 to be fed onto boss 20 more easily; i.e., grooves 37 are wider at the rear end 40 of wear member 15 as compared to the narrow front ends 41 of rails 24. As a result, the wear member can be tilted at various angles when it is initially fed onto the rails 24 and then directed into the right orientation by the widening of the rails. Moreover, if the wear member is formed with lateral wings, as discussed below, the narrowing rails permit the wear member 15 to be purposefully titled at an angle to permit the wings to clear the adjacent components as wear member 15 is fed onto boss 20. The narrowing of rails 24 and grooves 37 also enables easier release of wear member 15 as rails and grooves are not slid along each other surfaces after initial release. Further, the corresponding curved portions 42, 43 on holding surface 25 and retaining surface 38 (surfaces 25, 38 could be curved their entire length or only at the front ends) resist certain vertical loads at a more perpendicular orientation and provide a stronger and more stable resistance. As alternatives, rails 24 and grooves 37 could narrow without curved surfaces to achieve some of the benefits of the invention. In addition, the entire rail could be curved. Also, the holding surface could have an inclined but linear configuration such that the rail narrows as it extended forward, but is not curved.

Inner face 87 of inner leg 72 includes a first recess 91 into which upstanding support 50 is received, and a second recess 92 into which the width of boss 20 is received. The first recess 91 includes a pair of opposed sidewalls 93 to bracket the sides 94 of support 50. The second recess 92 includes a pair of opposed sidewalls 95, spaced farther apart than sidewalls 93, to receive the entire width of boss 20. By using this double set of recesses 91, 92, the wear member 15 is more stably mounted on boss 20 and better able to resist side loads.

When wear member 15 is installed, it is slid over boss 20 such that inner and outer legs 71, 72 straddle the lip (FIGS. 1-4). Rails 24 are fit within grooves 37 as shroud 15 is moved rearward. As discussed above, wear member 15 can be tilted at various angles and still fit onto the rails for easier installation. The rearward movement of shroud 15 is continued until inside corner surface 89 abuts front face 49 of boss 20. At this juncture, rear ends 33 of flanges 35 of outer leg 71 are preferably placed in close proximity to stop surface 32. With new cast parts, it is not practical for inside corner surface 89 and rear ends 33 to simultaneously abut front face 49 and stop surface 32, respectively. However, by placing rear ends 33 in close proximity with stop surface 32, the two surfaces will typically abut after a short amount of time as wear develops in the parts or under heavy loading to provide extra support to the shroud and provide enhanced protection for the lip. Outer leg 71 overlies outer leg 21 of boss 20 and outer face 18 of lip 16, and inner leg 72 overlies inner leg 22 of boss 20 and ramp surface 17*a* of lip 16. Inner leg 72, along inner surface 87, includes two sets of side surfaces 93, 95. Support 50 fits within recess 91 and the entire boss 20 fits within recess 92 for enhanced support and stability.

Inner leg 72 includes an aperture 86 adapted to receive lock 56. In the preferred embodiment, aperture 86 has a main portion 90 having a generally rectangular configuration to match the shape of the preferred lock, though other shapes are possible, and a stem portion 97 that opens in the rear wall 98 of inner leg 72 to provide clearance for plug member 58. The rear wall 88 of aperture 86 forms a bearing surface to each side of stem portion 92 to abut lock 56.

In the preferred construction, lock 56 includes a body 101 having a generally parallelepiped configuration that corresponds to the shape of aperture 86 (FIGS. 8-11), though other shapes can be used. The body includes a front wall 103, a rear wall 104, and sidewalls 105, 106. A threaded bore 109 extends through body 101 and opens in front and rear walls 103, 104. Plug member 58 includes a threaded shank 111 to be threaded into bore 109, and a tool-engaging formation 113 on rear end 115. While in the preferred construction formation 113 is formed as a hex-shaped socket, the socket could have other shapes or be replaced with other kinds of flats adapted to cooperate with tools to effect turning of the plug. The front end 117 of plug 58 is adapted to project forward and abut rear wall 52 of support 50. A recess 57 is preferably formed in front wall 53 of aperture 86 to give clearance for the mount of plug 58. In this way, the assembly has a more compact profile. Plug member 58 can be advanced so as to push against rear wall 52 of support 50, which in turn, presses rear wall 104 of lock 56 against rear wall 88 of aperture 86. This movement of plug member 58, then, causes shroud 15 to be pushed tightly against front face 49 of boss 20. A tighter fit reduces the shifting of the shroud during use, which will in turn reduce the amount of wearing among the components. Nevertheless, a lock without an adjustment assembly could also be used.

A retainer 121 is also preferably provided to resist unintended loosening of plug member 58. In the preferred construction, retainer 121 includes a threaded bolt 123 and a retaining ring 125. Retaining ring 125 has a non-circular internal hole 127 that matches the exterior of head 113 of plug member 58, which is preferably a hex shape. The bolt 123 has a threaded shank 131 that threads into a second threaded bore 133 and a head 135 that tightens against retaining ring 125 to prevent its rotation. Of course, other retainers could also be used.

When shroud 15 is fit onto lip 16, the front wall 53 of aperture 86 is generally aligned with rear wall 52 of support 50, though it could also be spaced rearward thereof, to permit lock 56 to fit within aperture 86 and be rearward of support 50. In this way, front wall 103 of lock 56 opposes rear wall 52 of support 50. As plug member 58 is advanced to engage rear wall 52, it preferably extends underneath leg 72. In this way, plug member 58 not only functions as a take up member to tighten the fit of the shroud against the boss, it also functions as a latch to hold the lock in aperture 86. Moreover, since the rear end 115 of plug member 58 sets within stem portion 92 (which can be easily cleared) the plug member can be easily retracted to remove the lock without concern over impacted fines blocking the movement.

In the preferred construction, one sidewall 105 of lock body 101 has an arcuate shape to fit against an arcuate sidewall 127 of aperture 86 so that the lock can be easily swung into aperture 86 (FIG. 10). Of course, other locks could be used to secure wear member 15 to boss 20.

The invention claimed is:

1. A wear member for a front edge of an excavating bucket comprising a front end and a rear end, the rear end having a first leg and a second leg, the legs being bifurcated to straddle the front edge of the bucket, the second leg having an aperture for receiving a lock for holding the wear member to the bucket, and the first leg being longer than the second leg and having a rearwardly-opening slot for receiving a boss fixed to the bucket, the slot having side grooves for receiving rails of the boss to provide support for the wear member during digging, each said side groove being defined by opposed first and second surfaces, wherein at least a front end of the first surface is axially curved in a rearward direction to accommodate initial mounting of the wear member onto the boss at an angular orientation that is different as compared to when fully seated, and to bear against a complementary portion of the rail when fully seated.

2. A wear member in accordance with claim 1 wherein the slot and grooves are defined by a pair of opposed flanges upstanding on said first leg.

3. A wear member in accordance with claim 1 further including a corner surface between the legs, the corner surface having a concave curved surface.

4. A wear member in accordance with claim 1 wherein the second leg includes an inner surface facing the bucket, the inner surface including a first recess having a pair of opposed first sidewalls for receiving a support on the boss fixed to the bucket and a second recess having a pair of opposed second sidewalls having greater separation than the first sidewalls for receiving outer sides of the boss.

5. A wear member in accordance with claim 1 wherein the first surfaces of the grooves each defines a concave curve in a rearward direction.

6. A wear member for a front edge of an excavating bucket comprising a front end and a rear end, the rear end having a first leg and a second leg, the legs being bifurcated to straddle the front edge of the bucket, the legs having inner surfaces that face toward each other, the second leg having an aperture for receiving a lock for holding the wear member to the bucket, and the first leg being longer than the second leg and having an axial connector for coupling to a complementary connector on a boss fixed to the bucket, the connector having holding surfaces that face toward the inner surface of the leg on which the connector is secured such that portions of the complementary connector of the boss are held between the holding surfaces and the inner surface of the respective leg across substantially their entire lengths, the connector having a narrowing depth as the connector extends in a direction toward the front end such that the holding surfaces are positioned gradually closer to the inner surface of the respective leg as the connector extends forward to accommodate initial mounting of the wear member onto the boss at an angular orientation that is different as compared to when fully seated.

7. A wear member in accordance with claim 6 wherein the connector is a slot with opposed side grooves that each has a depth that narrows in a forward direction.

8. A wear member in accordance with claim 7 in which each said side groove is defined at least by opposed first and second surfaces, wherein the first surface is generally formed with a convex curve.

9. A wear member in accordance with claim 7 wherein the slot and grooves are defined by a pair of opposed flanges upstanding on the first leg.

10. A wear member in accordance with claim 6 further including a corner surface between said legs, said corner surface having a concave curved surface.

11. A wear member in accordance with claim 6 wherein the first leg includes an inner surface facing the bucket, the inner surface including a first recess having a pair of opposed first sidewalls for receiving a support on a boss fixed to the bucket and a second recess having a pair of opposed second sidewalls having greater separation than the first sidewalls for receiving outer sides of the boss.

12. A wear member for a front edge of an excavating bucket comprising a front end, a rear end having an inner leg and an outer leg, the legs being bifurcated to straddle the front edge of the bucket, the inner leg having an inner surface facing the bucket and an aperture for receiving a lock for holding the wear member to the bucket, the inner surface including a first recess having a pair of opposed first sidewalls for receiving a support on a boss fixed to the bucket and a second recess having a pair of opposed second sidewalls having greater separation than the first sidewalls for receiving outer sides of the boss.

13. A wear member in accordance with claim 12 wherein the outer leg includes an axial connector that couples with a complementary connector on a boss fixed to the excavating bucket.

14. A wear member in accordance with claim 13 wherein the axial connector is a slot.

15. A wear assembly for a front edge of an excavating bucket comprising:

a boss fixed to the bucket, the boss having an axial connector with rails, wherein front portions of the rails are curved in an axial direction;

a wear member for a front edge of an excavating bucket comprising a front end and a rear end, the rear end having a first leg and a second leg, the legs being bifurcated to straddle the front edge of the bucket, the legs having inner surfaces that face toward each other, the second leg having an aperture for receiving a lock for holding the wear member to the bucket, and the first leg having an axial connector with holding surfaces that face toward the inner surface of the leg on which the connector is secured such that the rails on the boss are held between the holding surfaces and the inner surface of the respective leg across substantially their entire lengths, wherein at least front portions of the holding surfaces are curved to complement and contact the front portions of the rails on the boss; and a lock received in the aperture to secure the wear member to the boss.

16. A wear assembly in accordance with claim 15 wherein the axial connectors of the boss and the wear member each narrow as they extend forward.

17. A wear assembly in accordance with claim 16 wherein the boss includes a front bearing surface that has a generally uniform curved configuration and the wear member includes a corner surface with a generally uniform curved configuration to bear against the front bearing surface.

18. A wear assembly in accordance with claim 16 wherein the second leg of the wear member includes an inner surface facing the bucket, the inner surface including a first recess having a pair of opposed first sidewalls for receiving a support on the boss fixed to the bucket and a second recess having a pair of opposed second sidewalls having greater separation than then the first sidewalls for recessing outer sides of the boss.

* * * * *